US006892820B2

(12) United States Patent
Divis et al.

(10) Patent No.: US 6,892,820 B2
(45) Date of Patent: May 17, 2005

(54) MODULAR RETRIEVABLE PACKER

(75) Inventors: Robert Divis, Houston, TX (US); Jason Bigelow, Houston, TX (US); Mark Mulligan, Glenavy (GB); David Wolfe, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 103 days.

(21) Appl. No.: 10/215,659

(22) Filed: Aug. 9, 2002

(65) Prior Publication Data

US 2004/0026092 A1 Feb. 12, 2004

(51) Int. Cl.[7] ..... E21B 33/122
(52) U.S. Cl. ..... 166/387; 166/180; 166/189
(58) Field of Search ..... 166/381, 387, 166/114, 179, 123, 180, 189, 196, 242.3, 120

(56) References Cited

U.S. PATENT DOCUMENTS

| | | | | | |
|---|---|---|---|---|---|
| 1,838,539 | A | * | 12/1931 | Doherty | 166/264 |
| 3,288,218 | A | * | 11/1966 | Young | 166/119 |
| 3,335,800 | A | * | 8/1967 | Myers | 166/119 |
| 3,746,093 | A | * | 7/1973 | Mullins | 166/217 |
| 4,289,200 | A | * | 9/1981 | Fisher, Jr. | 166/120 |
| 4,508,172 | A | * | 4/1985 | Mims et al. | 166/303 |
| 4,898,245 | A | * | 2/1990 | Braddick | 166/387 |
| 5,103,902 | A | * | 4/1992 | Ross et al. | 166/120 |
| 5,129,454 | A | * | 7/1992 | Telfer | 166/120 |
| 5,425,418 | A | * | 6/1995 | Arizmendi et al. | 166/120 |
| 5,826,652 | A | * | 10/1998 | Tapp | 166/120 |
| 6,186,277 | B1 | * | 2/2001 | Tervo | 184/6.12 |
| 6,257,339 | B1 | * | 7/2001 | Haugen et al. | 166/387 |
| 6,467,540 | B1 | * | 10/2002 | Weinig et al. | 166/120 |

FOREIGN PATENT DOCUMENTS

| | | |
|---|---|---|
| GB | 2371062 A | 7/2002 |
| GB | 2385364 A | 8/2003 |

* cited by examiner

*Primary Examiner*—David Bagnell
*Assistant Examiner*—Daniel P Stephenson
(74) *Attorney, Agent, or Firm*—Trop, Pruner & Hu, P.C.; Jaime A. Castano; Brigitte Jeffrey Echols

(57) ABSTRACT

A packer that is usable with a subterranean well includes an assembly to circumscribe one out of multiple tubular arrays that are inserted through the packer. The packer also includes a member that is separable from the assembly to configure the assembly for connection to the tubular array. The member includes a first seal between the member and the tubular array and a second seal that is located between the member and the shell. The first seal is separate from the second seal. The assembly includes a slip to engage a casing of the well and a sealing element to seal an annulus of the well.

42 Claims, 10 Drawing Sheets

MODULAR RETRIEVABLE PACKER

BACKGROUND

The invention generally relates to a modular retrievable packer.

A packer is a device that is used in an oilfield well to form a seal for purposes of controlling production, injection or treatment. In this manner, the packer is lowered downhole into the well in an unset state. However, once in the appropriate position downhole, the packer is controlled from the surface of the well to set the packer. As an example, for a mechanically-set packer, a tubular string that extends from the surface to the packer may be moved pursuant to a predefined pattern to set the packer. For a hydraulically-set packer, fluid inside the tubular string may be pressurized from the surface, creating a tubing pressure differential to set the packer.

In its set state, the packer anchors itself to the casing wall of the well and forms a seal in the annular region between the packer and the interior surface of the casing wall. This seal subdivides the annular region to form an upper annular region above the packer that is sealed off from a lower annular region below the packer. The packer also forms a seal for conduits that are inserted through the packer between the upper and lower annular regions. As examples, one of these conduits may communicate production fluid from a production zone that is located below the packer, one of the conduits may communicate control fluid through the packer, one of the conduits may house electrical wiring for a submersible pump, allow production or injection through two different reservoir zones, etc.

As a more specific example, FIG. 1 depicts a well that includes a packer 20. As shown, the packer 20 may be connected to a tubular string 16 that extends downhole into the well. The packer 20 forms an annulus seal with the interior surface of a wall of a casing string 12 that circumscribes the packer 20. The packer 20 typically includes at least one seal assembly 24 to form the annulus seal and at least one set of slips 22 to anchor the packer 20 to the casing string 12. In this manner, when run into the well, the seal assembly 24 and the slips 22 are radially retracted to allow passage of the packer 20 through the central passageway of the casing string 12. However, when the packer 20 is in the appropriate downhole position, the packer 20 is set to place the packer 20 in a state in which the seal assembly 24 and slips 22 are radially expanded. When radially expanded, the slips 22 grip the interior surface of the wall of the casing string 12 to physically anchor the packer 20 in position inside the well. The radial expansion of the seal assembly 24, in turn, seals off the annular space between the string 16 and the casing string 12 to form a sealed annular region above the seal assembly 24 and a sealed annular region below the seal assembly 24.

The packer 20 may be hydraulically actuated for purposes of controlling the packer 20 from the surface of the well to set the packer 20. This means that pressure may be communicated through fluid inside the string 16 to the packer 20. In response to this pressure reaching a predefined threshold level, pistons (not shown in FIG. 1) move to radially expand the slips 22 and apply compressive forces on the seal assembly 24 to radially expand the assembly 24. A retention mechanism of the packer 20 serves to hold the packer 20 in the set state when the pressure that is used to set the packer 20 is released.

One or more mandrels 21, or tubular elements, may extend through the packer 20 for purposes of providing communicating paths through the packer 20. Depending on the particular application of the packer 20, a particular mandrel 21 may contain one or more communication paths, such as paths to communicate production fluid, electrical lines, or control fluid through the packer 20. For example, in a particular application, a single mandrel 21 may extend through the packer 20 for purposes of communicating production fluid from a tubular string 23 located below the packer 20 to the string 16 located above the packer 20. However, in other applications, more than one mandrel 21 may be extended through the packer 20. Thus, one mandrel 21 maybe used for purposes of communicating electrical or hydraulic lines, for example, and another mandrel 21 may be used for purposes of communicating production fluid through the packer 20.

The packer 20 may be retrievable, and thus may include a release mechanism that when engaged, releases the retention mechanism of the packer 20 to radially retract the slips 22 and seal assembly 24 to permit retrieval of the packer 20 to the surface of the well.

The packer 20 establishes two general seals: an interior seal between the interior of the packer 20 and the exterior of the one or more mandrels 21 that are extended through the packer 20; and an exterior seal between the exterior of the packer 20 and the interior surface of the wall of the casing string 12. Because the mandrel configuration may change depending on the particular application of the packer, a given packer design may need to be modified to accommodate the particular application. Thus, for example, the packer 20 may have a first design for an application in which a single mandrel extends through the packer 20. However, the design of the packer 20 must be redesigned for an application in which two mandrels are extended through the packer 20. In this manner, the exterior profiles and structure that are presented by two mandrels are significantly different from the exterior profiles and structures that are associated with one mandrel, thereby requiring a substantial redesign of the packer's interior sealing rings and structure that establishes the packer's interior seal. Furthermore, the design of the packer 20 may need to be redesigned to accommodate different size mandrels or additional mandrels that are inserted through the packer 20.

Thus, there is a continuing need for an arrangement that addresses one or more of the problems that are set forth above.

SUMMARY

In an embodiment of the invention, a packer that is usable with a subterranean well includes an assembly to circumscribe one out of multiple tubular arrays that are inserted through the packer. The packer also includes a member that is separable from the assembly to configure the assembly for connection to the tubular array. The member includes a first seal between the member and the tubular array and a second seal that is located between the member and the shell. The first seal is separate from the second seal. The assembly includes a slip to engage a casing of the well and a sealing element to seal an annulus of the well.

Advantages and other features of the invention will become apparent from the following description, drawing and claims.

DETAILED DESCRIPTION

Figure 1:
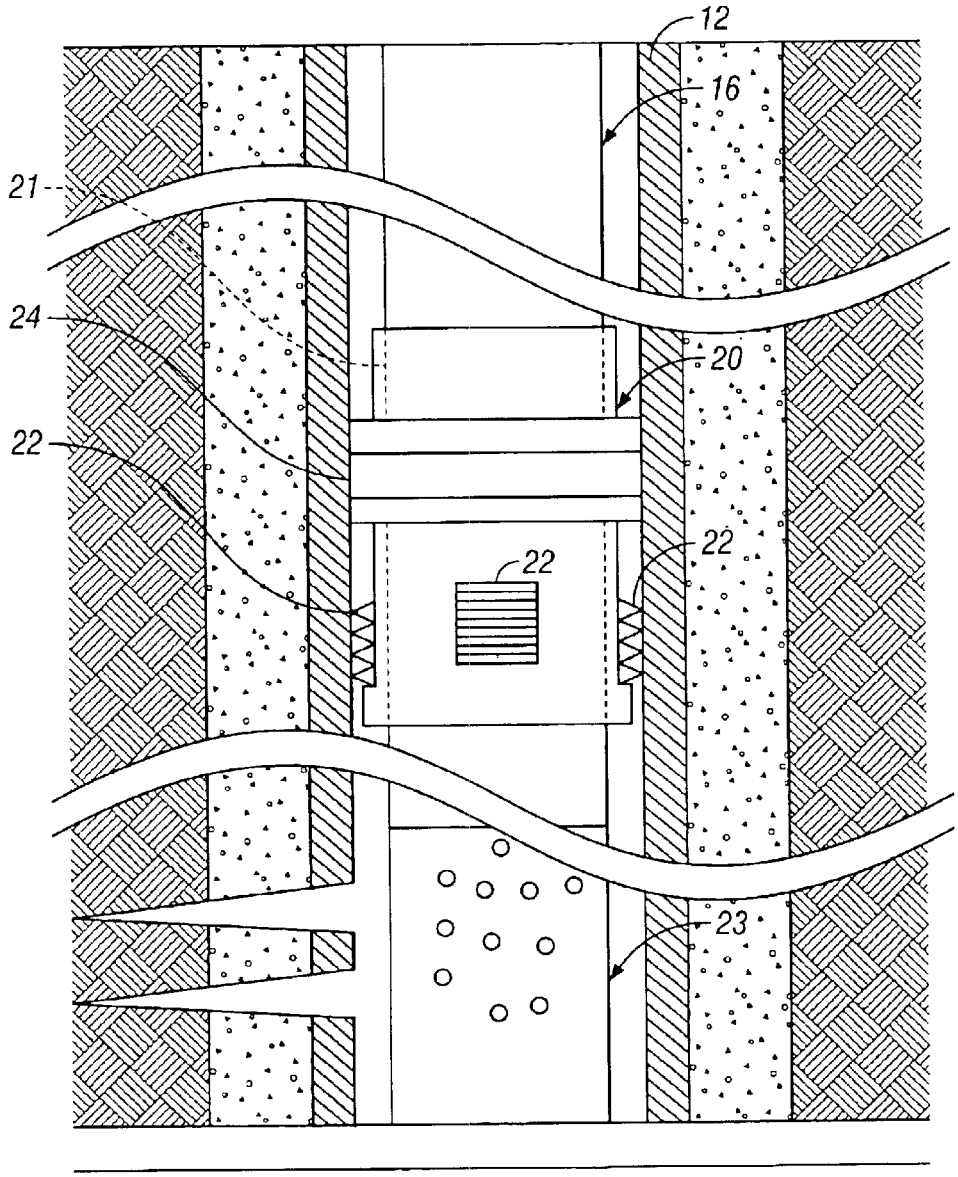
FIG. 1 (Prior Art)
FIG. 1 is a schematic diagram of a packer of the prior art.
Figure 2:
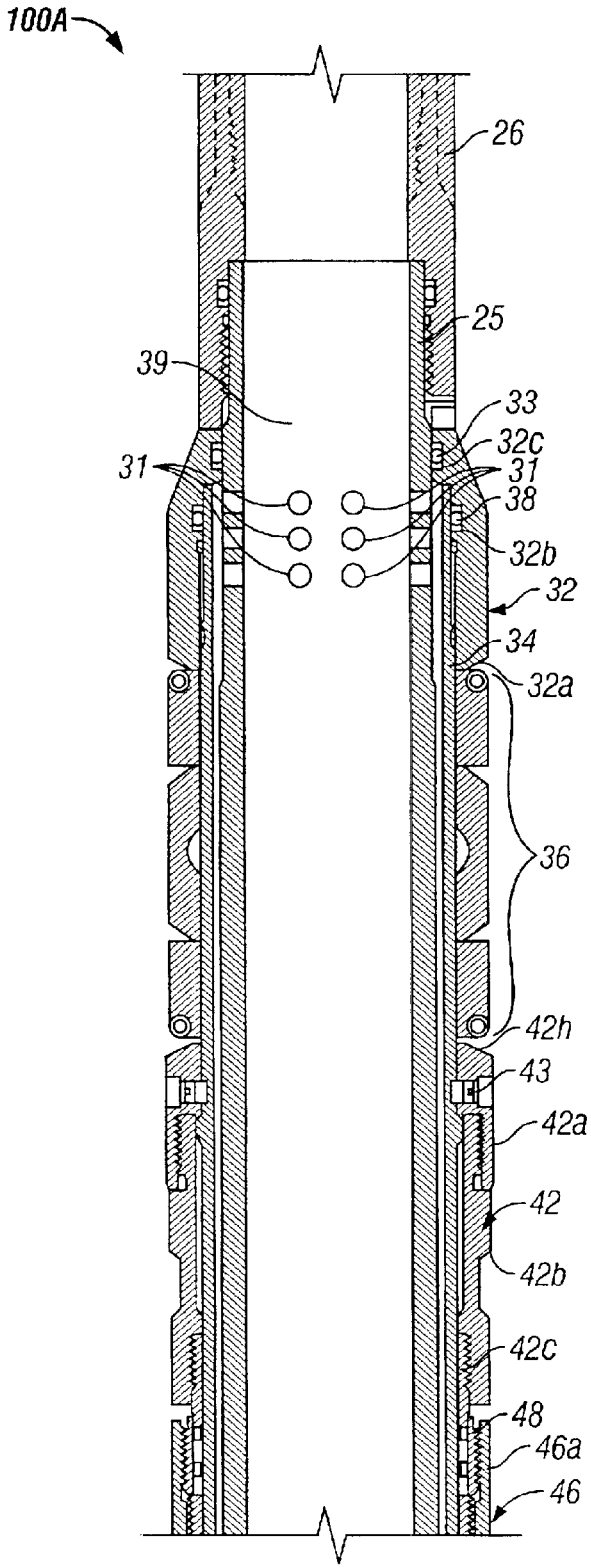
FIGS. 2 and 3 are schematic diagrams of a packer in accordance with an embodiment of the invention depicting a state of the packer when run into a well.
Figure 3:
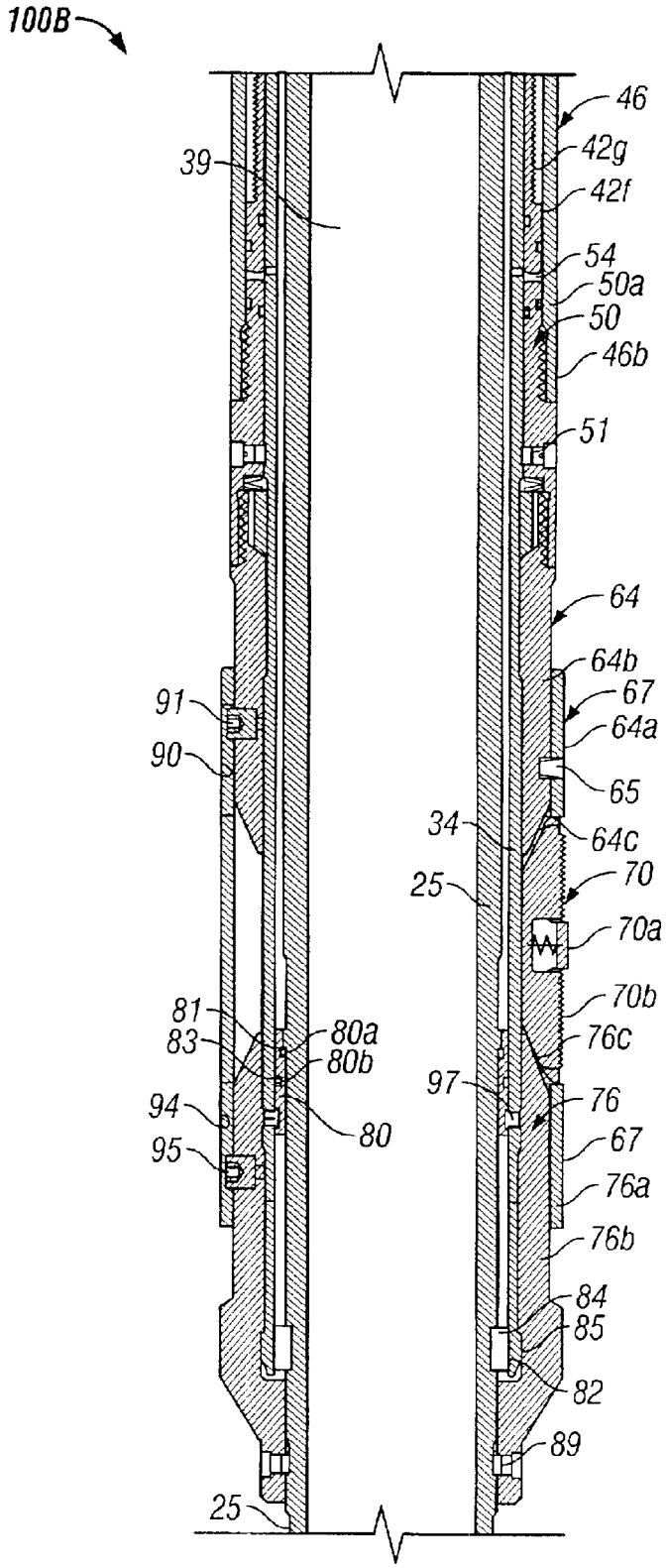

An embodiment of a packer in accordance with the invention is depicted in its run in state in FIGS. 2 and 3. FIG. 2 depicts an upper section 100A of the packer, and FIG. 3 depicts the lower section 100B of the packer. In this run in state, the packer is ready to be run into a well to the appropriate position at which the packer may be set, as described further below.

The packer includes one or more internal tubes, or mandrels, that extend through the packer for purposes of establishing one or more communication paths through the packer. In the embodiment that is depicted in FIGS. 2 and 3, the packer includes an internal tubing, or mandrel 25, that extends through the packer for purposes of establishing fluid communication between a tubular member 26 that extends above the packer and a tubular member (not shown in FIG. 2 or 3) that extends below the packer.

The packer forms a seal between the packer and the exterior surface(s) of the one or more mandrels. Thus, the different mandrel configurations require different seals. However, the packer has a design that minimizes the number of components that must be changed to reconfigure the packer from a first configuration for use with a particular mandrel configuration (such as the mandrel configuration depicted in FIGS. 2 and 3) to a second mandrel configuration for use with a different mandrel configuration (a two mandrel configuration, for example).

In some embodiments of the invention, the ability of the packer to be easily reconfigured flows from the modular design of the packer. Referring to FIGS. 2 and 3, in some embodiments of the invention, the packer includes an internal and generally circularly cylindrical shell 34. The shell 34 has a central passageway through which the internal mandrel 25 extends. Mounted on the exterior of the shell 34 are components that are associated with anchoring the packer to the casing wall and forming a seal between the packer and the casing wall. In this manner, these components may include, for example, a set of slips 70 (one slip being depicted in FIGS. 2 and 3) that are spaced regularly around the periphery of the packer to anchor the packer to the casing string, and these components may also include an elastomer seal assembly 36 (FIG. 2) that circumscribes the shell 34 and is compressed to seal off the well annulus. As further described below, also mounted on the exterior of the shell 34 are various pistons and other devices used to set and unset the elastomer seal assembly 36 and the slips 70, as described below. Thus, the shell 34 forms a basic structure of a shell assembly that includes the shell 34 and components that are associated with anchoring the packer to the casing wall and forming a seal between the casing wall and the packer.

For purposes of facilitating the redesign of the packer for different mandrel configurations, unlike conventional packers, sealing rings do not directly bridge the space between the interior surface of the shell 34 and the exterior surface of the mandrel 25. The inclusion of such sealing rings that form direct seals between the shell 34 and mandrel 25 hinders the reconfiguration of the packer, as specific grooves must be formed in the exterior surface of the mandrel 25 and/or in the interior surface of the shell 34 to accommodate these sealing rings. Thus, for example, the grooves and general design of the shell for a one mandrel design would be different than the design of the shell for a two mandrel design. This means a different shell would have to be used for each configuration. However, unlike conventional packers, the packer has a different design in which seals between the shell 34 and mandrel(s) are established by separate components, called sealing bulkheads with the diversity to change the internal configuration without changing most of the components on the shell.

In this manner, for the embodiment of the packer 20 depicted in FIGS. 2 and 3, the packer includes an upper sealing bulkhead 32. This upper sealing bulkhead 32 includes a first sealing ring to form a seal between the bulkhead 32 and the mandrel 25 and a second sealing ring to form a seal between the bulkhead 32 and the shell 34. Similarly, the packer includes a lower sealing bulkhead 80 (see FIG. 3) that includes a third sealing ring to form a seal between the bulkhead 80 and the mandrel 25 and includes a fourth sealing ring to form a seal between the bulkhead 80 and the shell 34. Thus, no sealing rings extend directly between the shell 34 and the mandrel 25, i.e., no seals are formed directly between the shell 34 (and shell assembly) and the mandrel 25.

Due to this arrangement, a different mandrel configuration is accommodated by simply changing the sealing bulkheads and sealing rings, as compared to redesigning the packer's shell assembly or another part of the packer associated with the anchoring and annulus sealing functions of the packer. In this manner, a particular set of upper and lower sealing bulkheads are used with one mandrel configuration, another set of upper and lower sealing bulkheads are used with a two mandrel configuration, a third set of upper and lower sealing bulkheads are used with mandrel configurations with mandrels having different diameters, etc. Thus, because only the sealing bulkheads and sealing rings are dependent on the mandrel configuration, design time and costs associated with reconfiguring the packer for different mandrel configurations are minimized.

Turning now to a more detailed description of the packer and more particularly referring to FIG. 2, in some embodiments of the invention, the upper sealing bulkhead 32 includes an annular groove 32*c* that holds a corresponding elastomer sealing ring 33 (an O-ring, for example) to form a seal between the upper sealing bulkhead 32 and the exterior surface of the mandrel 25. The upper sealing bulkhead 32 also includes an annular groove 32*b* that holds an elastomer sealing ring 38 (an O-ring, for example) to form a seal between the upper sealing bulkhead 32 and the shell 34. Thus, with these two sealing rings 33 and 38, the upper sealing bulkhead 32 forms a seal between the shell 34 and the mandrel 25.

The upper sealing bulkhead 32 has a lower annular inclined surface 32*a* that forms a shoulder that, in turn, abuts an upper annular contact surface of the elastomer seal assembly 36. As described below, when the packer is set, a piston of the packer exerts an upward force on the elastomer seal assembly 36, forcing the elastomer seal assembly 36 against the surface 32*a* and causing the seal assembly 36 to radially expand.

In some embodiments of the invention, the packer is hydraulically actuated by fluid pressure that is applied through a central passageway 39 of the mandrel 25. For purposes of establishing fluid communication between pistons of the shell assembly and the central passageway 39, the mandrel 25 includes radial fluid ports 31 that extend through the sidewall of the mandrel 25. In this manner, the pressure on the fluid in the central passageway 39 is increased to actuate the pistons to set the packer. Afterwards, the applied pressure is decreased, or bled off. As described below, the packer includes a retention mechanism to hold the packer in its set state, even after the applied fluid pressure is released.

As also described below, the packer may be retrieved by exerting an upward force of sufficient magnitude on a tubular string that is connected to the mandrel 25 and extends to the surface of the well. In this manner, a sufficient upward force on the mandrel 25 engages a release mechanism of the packer to release the slips 70 (FIG. 3) and elastomer seal assembly 36 to permit radial retraction of these devices and the retrieval of the packer to the surface of the well.

In some embodiments of the invention, the force to radially expand the elastomer seal assembly 36 is applied by an upper piston assembly 42 that circumscribes the shell 34. The piston assembly 42 includes an upper sleeve 42*a* that circumscribes the shell 34 and has an upper annular inclined surface 42*h* to contact a lower annular contact surface of the seal assembly 36. For purposes of preventing the inadvertent setting of the packer, the upper sleeve 42*a* is initially held in place to the shell 34 via one or more shear screws 43. In this manner, when the packer is set, enough upward force is applied on the piston assembly 42 to shear the shear screws 43 to permit compression of the elastomer seal assembly 36 by the piston assembly 42.

In addition to the upper sleeve 42*a*, the upper piston assembly 42 includes an intermediate sleeve 42*b* that is located below and is connected to the upper sleeve 42*a*. The intermediate sleeve 42*b*, in turn, circumscribes the shell 34, and is located above and is connected to a lower sleeve 42*c* of the piston assembly 42. This lower sleeve 42*c* also circumscribes the shell 34. The lower end of the lower sleeve 42*c*, in turn, includes a piston head 42*f* (FIG. 3) that is in fluid communication with an expandable chamber 54.

Referring to FIGS. 2 and 3, an annular region that is defined radially between the exterior surface of the mandrel 25 and the inner surface of the shell 34 and longitudinally between the upper 32 and lower 80 sealing bulkheads communicates fluid between the radial ports 31 of the mandrel 25 and the chamber 54. Due to this communication, an upward force is exerted on the upper piston assembly 42 in response to the fluid inside the central passageway 39 being pressurized. After the shear pins 43 shear, this upward force causes upward movement of the piston assembly 42 that, in turn, applies a compressive force to radially expand the seal assembly 36.

Referring to FIG. 3, in some embodiments of the invention, the packer includes a lower piston assembly 50 that circumscribes the shell 34 and resides below the expandable chamber 54. In this manner, the piston assembly 50 includes a piston head 50*a* that is in fluid communication with the chamber 54. Because the piston head 50*a* is located below the chamber 54, when sufficient pressure is applied to the fluid inside the central passageway 39, the piston assembly 50 moves in a downward direction. As described below, this movement of the piston assembly 50 causes the radial expansion of the slips 70.

More particularly, the piston assembly 50 is formed from a generally circularly cylindrical sleeve that circumscribes the shell 34. The piston assembly 50 is initially held in place to the shell 34 by one or more shear screws 51. However, after sufficient fluid pressure is applied to expand the chamber 54, the shear screws 51 shear, thereby freeing the piston assembly 50 to move in a downward direction.

The sleeve that forms the piston assembly 50 is connected to a generally circularly cylindrical upper cone assembly 64 that circumscribes the shell 34. The upper cone assembly 64 moves downwardly with the piston assembly 50 to apply force to the slips 70 for purposes of causing the slips 70 to radially expand. In this manner, in the depiction of the packer of FIG. 3, the cone assembly 64 includes a lower inclined annular face 64*c* that contacts the inclined faces of the slip 70. Thus, when the lower piston assembly 50 moves in a downward direction, the inclined face 64*c* of the cone assembly 64 pushes against the corresponding inclined faces of the slips 70 to force the slips 70 in radially outward directions. Each slip 70 is held in position by a spring-biased connection 70*a* that radially retracts the slip 70 when the cone assembly 64 is not pushing against the slip 70.

In some embodiments of the invention, a generally circularly cylindrical outer sleeve 67 circumscribes the upper cone assembly 64. The sleeve 67 has openings through which the slips 70 extend. The sleeve 67 is initially secured to the upper cone assembly 64 via one or more shear screws 65. In this manner, after the lower piston assembly 50 exerts sufficient force against the cone assembly 64, the shear screws 65 shear, thereby allowing movement of the upper cone assembly 64 and thus, the extension of the slips 70.

A lower cone assembly 76 abuts a lower inclined annular surface of each slip 70. In this manner, the lower cone assembly 76 is circumscribed by the outer sleeve 67 and includes an inclined annular surface 76*c* that mates with corresponding inclined surfaces of the slips 70 to produce a force to radially extend the slips 70 when the lower piston assembly 50 moves in a downward direction. The lower cone assembly 76 is secured to the mandrel 25 via one or more shear screws 89.

As described further below, the shear screws 89 shear in response to a sufficient upward force that is exerted on the mandrel 25 to cause the packer to transition from a set state to an unset state for retrieval from the well. In this manner, when the packer is set, the lower cone assembly 76 is fixed in position. Thus, the application of an upward force on the mandrel 25 causes the shear screws 89 to shear, thereby freeing the mandrel 25 to move relative to the lower cone assembly 76. The release of the packer from its set state is further described below.

Among the other features of the packer, the packer may include a pin and slot arrangement to permit a limited movement between the upper 64 and lower 76 cone assemblies and the outer sleeve 67. Such movement permits movement for purposes of setting the slips 70, but the range of movement is limited for purposes of disengaging the packer from its set state, as described further below. The pin and slot arrangement includes one or more upper slots 90 that are formed in the outer sleeve 67 above the slips 70 and one or more lower slots 94 that are formed in the outer sleeve 67 below the slips 70. Each upper slot 90 is associated with a pin 91 that radially extends from the upper cone assembly 64 into the associated upper slot 90. Each lower slot 94 is associated with a pin 95 that radially extends from the lower cone assembly 76 into the associated lower slot 94.

The lower sealing bulkhead 80 is generally circularly cylindrical, circumscribes the mandrel and is circumscribed by the shell 34. The lower sealing bulkhead 80 includes an interior annular groove 80*a* that holds an elastomer sealing ring 81 (an O-ring, for example) that forms the seal between the interior surface of the bulkhead 80 and the exterior surface of the mandrel 25. The lower sealing bulkhead 80 also includes an exterior annular groove 80*b* that holds an elastomer sealing ring 83 (an O-ring, for example) that forms the seal between the exterior surface of the bulkhead 80 and the interior surface of the shell 34. In some embodiments of the invention, the lower sealing bulkhead is secured to the shell 34 via one or more screws 97.

Referring to FIGS. 2 and 3, for purposes of maintaining the set state of the packer after the release of the fluid pressure in the central passageway 39, the packer includes a sleeve 46 that is generally circularly cylindrical and circumscribes the lower portion of the upper piston assembly 42 and the upper portion of the lower piston assembly 50. The sleeve 46 forms a set retention mechanism by forming a non-retractable extension between the upper 42 and lower 50 piston assemblies; and this extension is increased in response to the upper movement of the upper piston assembly 42 and the lower movement of the lower piston assembly 50.

More specifically, a lower end 46*b* (FIG. 3) of the sleeve 46 is attached to the lower piston assembly 50; and an upper end 46*a* (FIG. 2) of the sleeve 46 is connected in a ratchet-type arrangement with the upper piston assembly 50. The upper portion 46*a* of the sleeve 46 includes teeth that engage exterior mating teeth of a ratchet ring 48 (FIG. 2). The ratchet ring 48 is circumscribed by the upper end 46*a* of the sleeve 46 and circumscribes the upper piston assembly 42. More specifically, interior ratchet teeth of the ratchet ring 48 interact with exterior ratchet teeth 42*g* of the upper piston assembly 42. The interior ratchet teeth of the ratchet ring 48 and the ratchet teeth 42 have profiles to permit the ratchet teeth 42*g* (and upper piston assembly 42) to move in an upward direction relative to the ratchet ring 48, but these profiles do not permit the ratchet teeth 42*g* (and upper piston assembly 42) to move in a downward direction relative to the ratchet ring 48. Due to this arrangement, when pressure is applied to the fluid to drive the piston assembly 42 in an upward direction and drive the lower piston assembly 50 in a downward direction, the sleeve 46 maintains the positions of the upper 42 and lower 50 piston assemblies, while allowing more movement in the upper and lower directions of the upper 42 and lower 50 piston assemblies, respectively. Thus, when pressure is released from the fluid in the central passageway, the piston assemblies 42 and 50 maintain the forces on the elastomer seal assembly 36 and the slips 70 to keep the packer in the set state.

Figure 4:
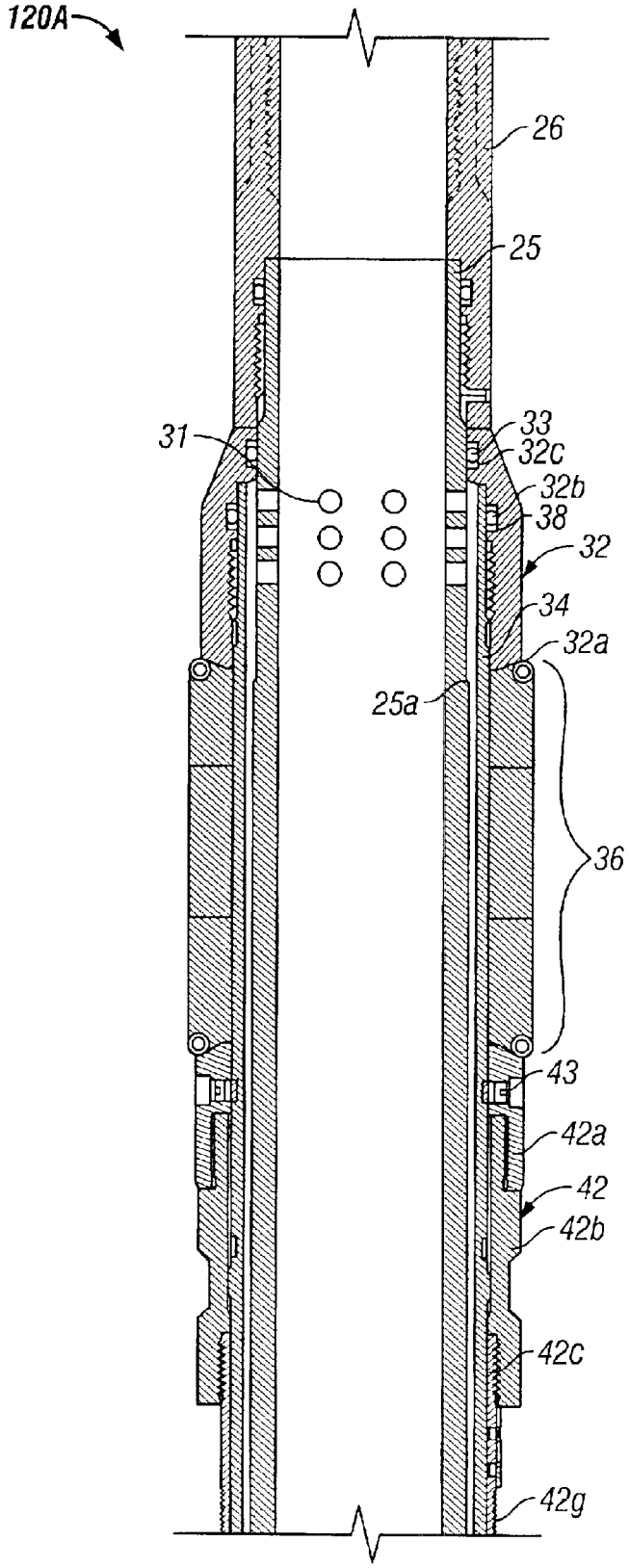
FIGS. 4, 5 and 6 are schematic diagrams depicting the packer in accordance with the invention in a state in which the packer is set.
Figure 5:
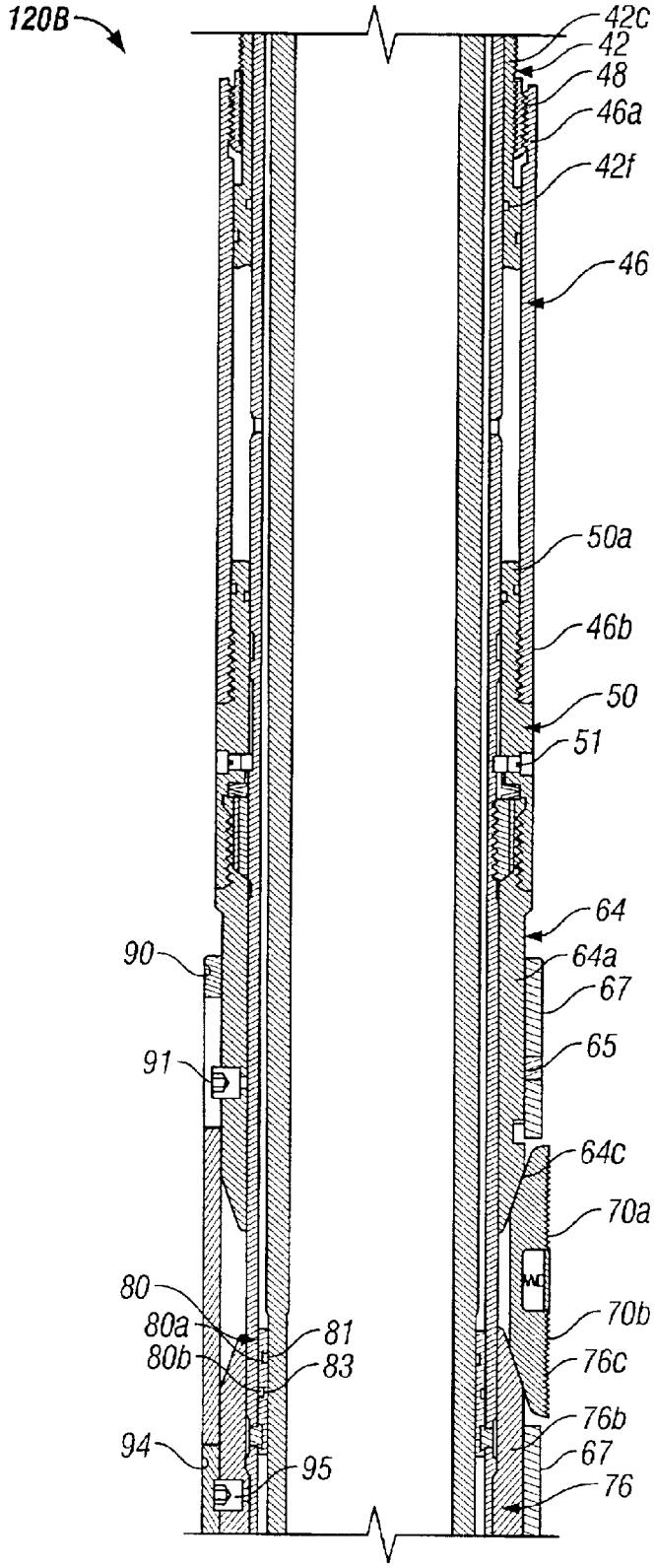
Figure 6:
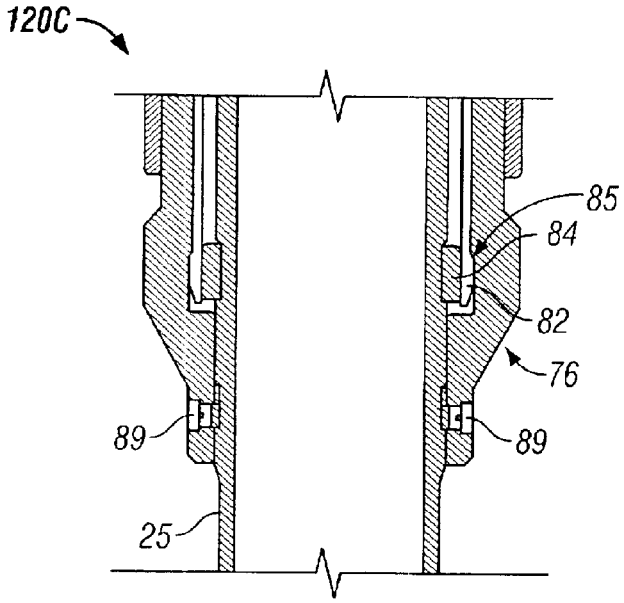

FIGS. 4, 5 and 6 depict upper 120A, intermediate 120B and lower 120C sections of the packer in the packer's set state. Referring to these figures, in its set position, the elastomer seal assembly 36 is expanded radially in an outward direction. Furthermore, the teeth 42*g* of the lower piston assembly 42 engage the ratchet ring 48 at a lower position so that the piston assemblies 42 and 50 are located by a distance apart that does not change when pressure is released from the fluid inside the central passageway. As depicted in FIG. 5, in the set position, the slip 70 is expanded so that teeth 70*b* of the slip 70 may engage the inner surface of the surrounding well casing string. As depicted in FIG. 4, in this position of the upper piston assembly 42, the shear screws 43 have been sheared, thereby allowing free movement of the upper piston assembly 42. Furthermore, in the depicted position of the lower piston assembly 50 in FIG. 5, the shear screws 51 have been sheared thereby allowing downward movement of the lower piston assembly 50.

Referring to FIG. 6, in the set position of the packer, a collet ring 82 of the packer has a shoulder 85 that engages a corresponding inner shoulder of the lower cone assembly 76. The collet ring 82 is pressed into this engagement by a retaining ring 84 that is positioned in a corresponding annular groove formed in the outer surface of the mandrel 25. The collet ring 82 is located below and abuts the shell 34. Thus, due to this arrangement, the collet ring 82 prevents movement of the shell 34 with respect to the mandrel 25. The movement of the mandrel 25 with respect to the lower cone assembly 76, in turn, is prevented via the shear screws.

Figure 9:
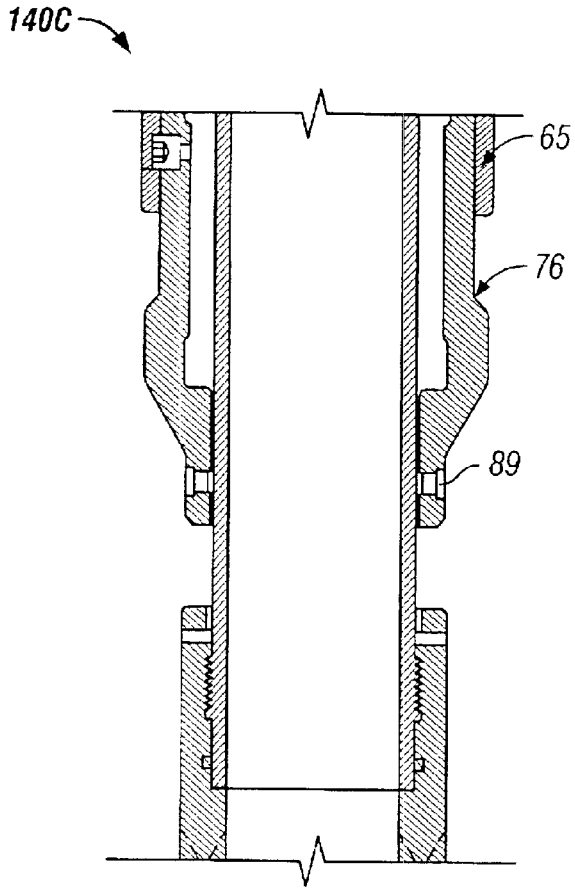
FIGS. 7, 8 and 9 are schematic diagrams depicting the packer in accordance with the invention in a state after the packer has been unset for purposes of retrieval of the packer from the well.
Figure 7:
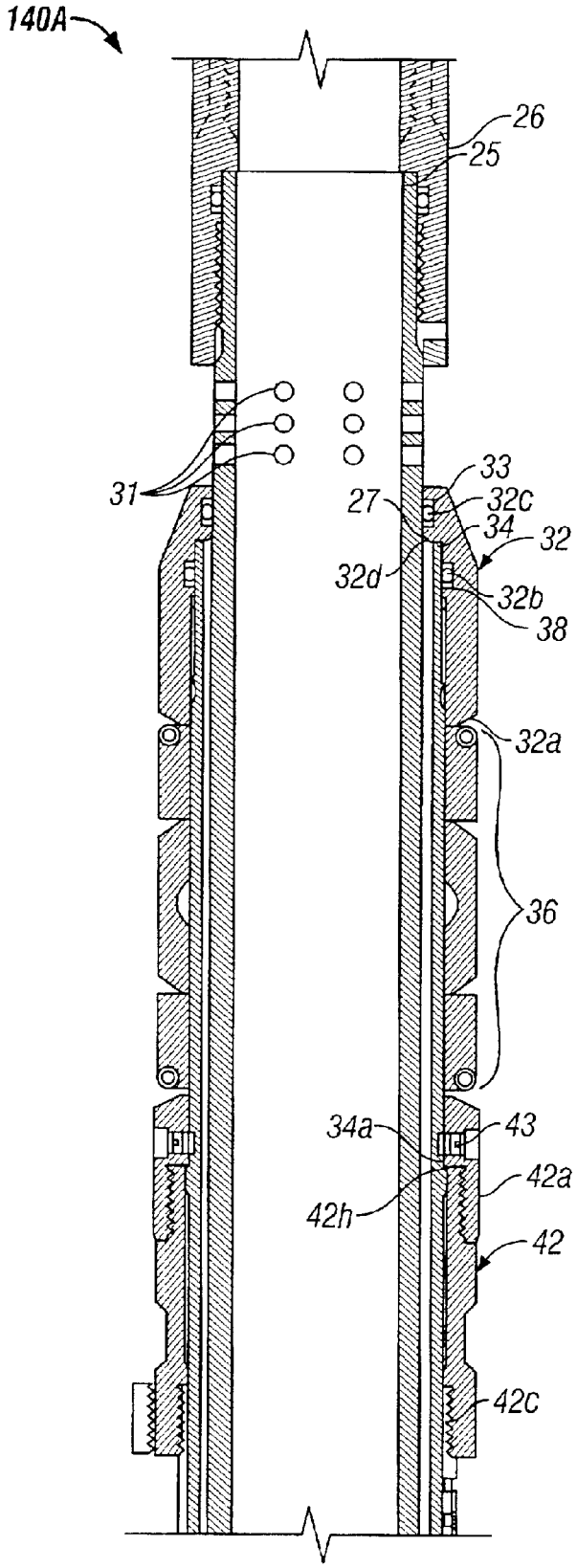
Figure 8:
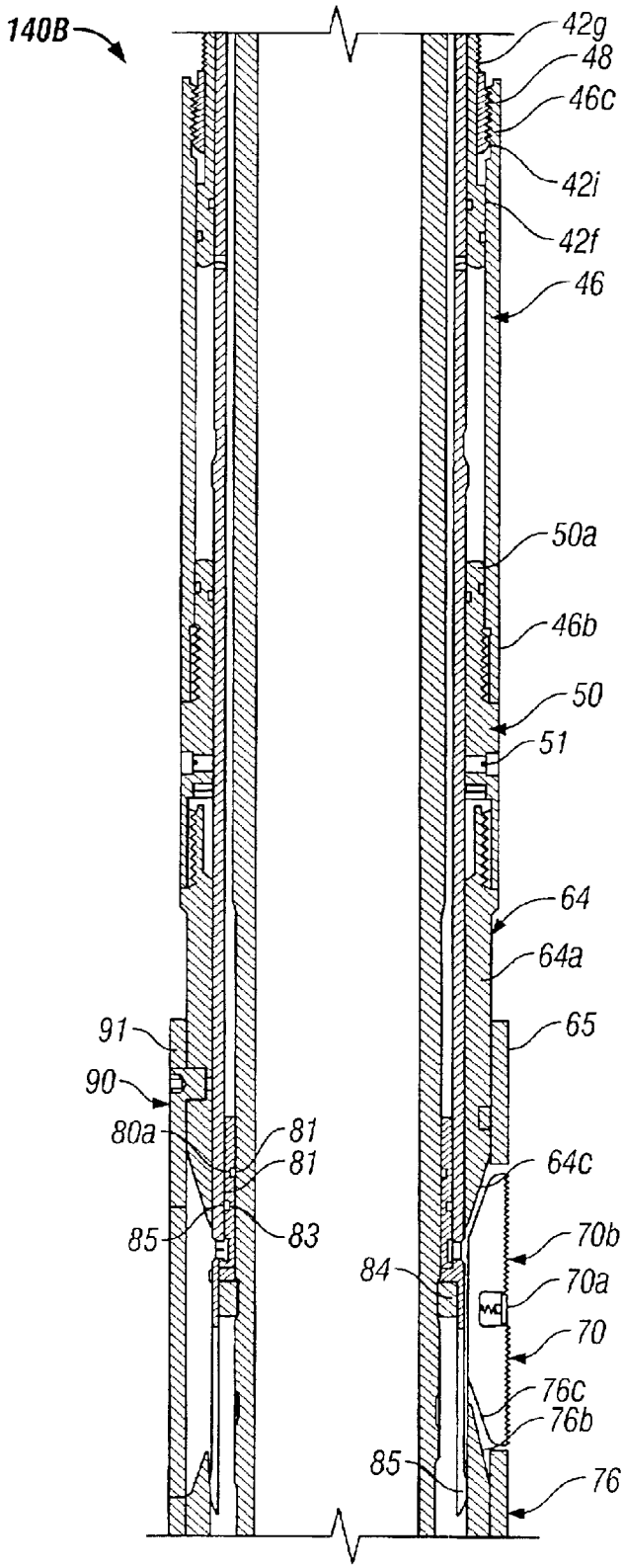

FIGS. 7, 8 and 9 depict upper 140A (FIG. 7) intermediate 140B (FIG. 8) and lower 140C (FIG. 9) sections of the packer after the packer has been released from its set state. In this manner, the release of the packer from its set state occurs in response to the application of a sufficient upward force to the tubing that is connected to the mandrel 25. This force, in turn, shears screws of the packer, discussed below, to release the actuating mechanisms of the packer to retract the elastomer seal assembly 36 and retract the slips 70.

More particularly, in some embodiments of the invention, the upper force on the mandrel 25 shears the shear screws 89 that connect the lower cone assembly 76 to the mandrel 25. Due to this released connection, the retaining ring 84 slides upwardly with the mandrel 25, thereby freeing the collet ring 82 to radially retract. This radial retraction of the collet ring 82, in turn, permits movement of the shell 34 with the mandrel 25. When the shell 34 moves in an upward direction, the shell contacts an upper shoulder 27 (see FIG. 7) of the upper sealing bulkhead 32, to cause movement of the upper sealing bulkhead 32 away from the elastomer seal assembly 36, thereby releasing pressure on the upper seal assembly 36. Due to the upward motion of the upper sealing bulkhead 32, the shell 34 further slides in an upward direction until a shoulder 34*a* of the shell 34 contacts a corresponding shoulder 42*h* (FIG. 7) of the upper piston assembly 42. This contact pulls the upper piston assembly 42, the sleeve 46 and the lower piston assembly 50 an upward direction to release the applied pressure on the slips 70. Furthermore, the pins 91 reach the upper limit of their respective slots 90 to pull the upper cone assembly 64 and the sleeve 65 in an upward direction to release pressure on the slip 70*b*.

Figure 10:
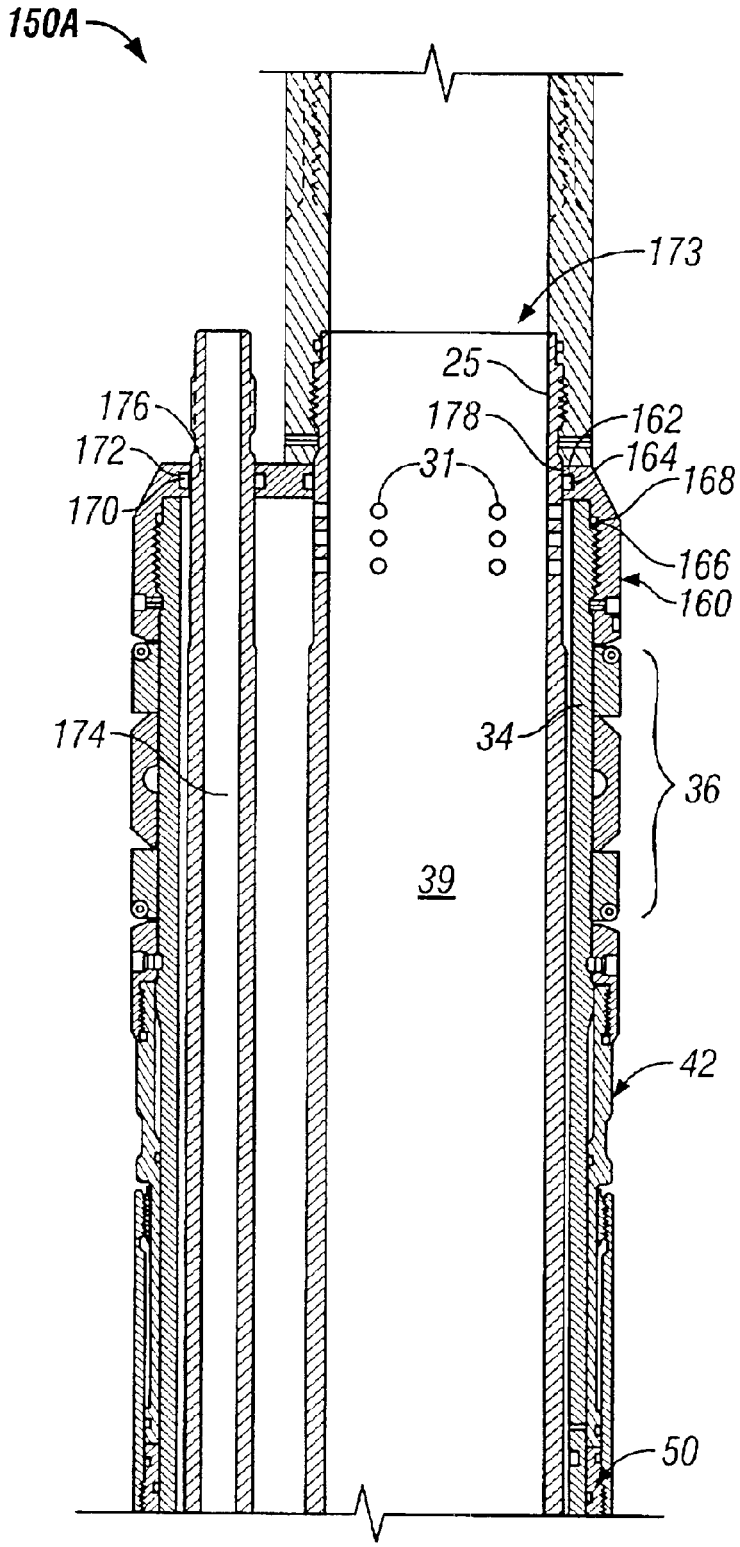
FIGS. 10 and 11 are schematic diagrams of a packer in accordance with another embodiment of the invention depicting a different mandrel configuration.
Figure 11:
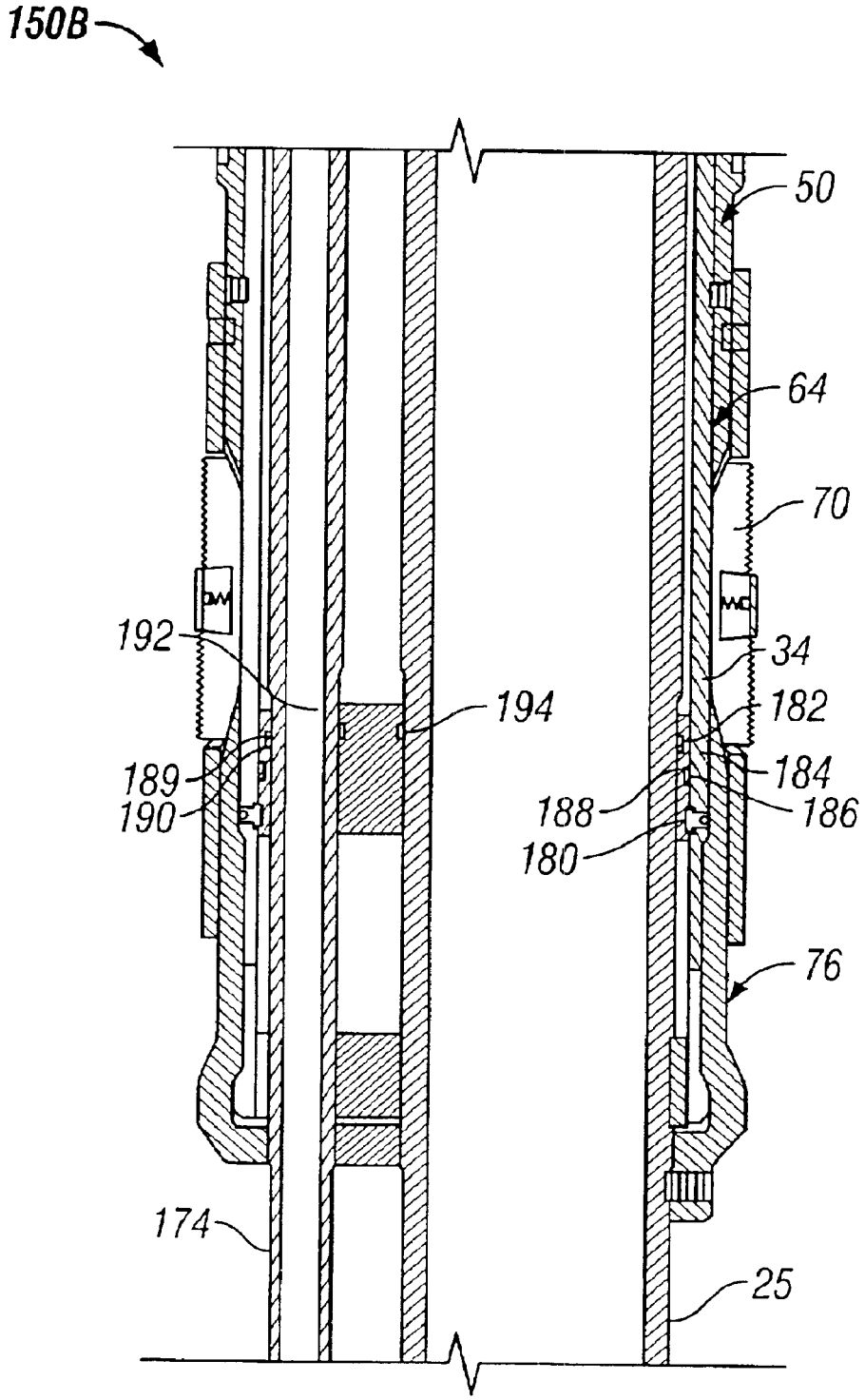

Different sealing bulkheads may be used in other embodiments of the invention. For example, FIGS. 10 and 11 depict upper 150A and lower 150B sections of a packer in accordance with another embodiment of the invention. In this embodiment, two mandrels pass through the packer: a primary mandrel 173 and a secondary mandrel 174. As an example, the primary mandrel 173 may be used for purposes of communicating production fluids, and the secondary mandrel 174 may be used as a bypass line or for purposes of providing a path for electrical and/or hydraulic communication lines through the packer. In this embodiment of the invention, the upper sealing bulkhead 32 is replaced with an upper sealing bulkhead 160 (FIG. 10), and the lower sealing bulkhead 80 is replaced by a lower sealing bulkhead 180.

Referring to FIG. 10, the upper sealing bulkhead 160 has an opening 178 to receive the primary mandrel 173 and an opening 176 to receive the secondary mandrel 174. An interior annular groove 162 that circumscribes the opening 178 holds an elastomer sealing ring 164 (an O-ring, for example) that forms a seal between the sealing bulkhead 160 and the primary mandrel 173. An interior annular groove 170 that circumscribes the opening 176 holds an elastomer sealing ring 172 (an O-ring, for example) that forms a seal between the sealing bulkhead 160 and the secondary mandrel 174. The sealing bulkhead 160 also includes an interior annular groove 166 that circumscribes the shell 34 and holds an elastomer sealing ring 168 (an O-ring, for example) that forms a seal between the sealing bulkhead 160 and the shell 34.

Referring to FIG. 11, the lower sealing bulkhead 180 has an opening 194 to receive the primary mandrel 173 and an opening 192 to receive the secondary mandrel 174. An interior annular groove 182 that circumscribes the opening 194 holds an elastomer sealing ring 184 (an O-ring, for example) that forms a seal between the sealing bulkhead 180 and the primary mandrel 173. An interior annular groove 189 that circumscribes the opening 192 holds an elastomer sealing ring 190 (an O-ring, for example) that forms a seal between the sealing bulkhead 180 and the secondary mandrel 174. The sealing bulkhead 180 also includes an exterior annular groove 186 that is circumscribed by the shell 34 and holds an elastomer sealing ring 188 (an O-ring, for example) that forms a seal between the sealing bulkhead 180 and the shell 34.

In the preceding description, directional terms, such as "upward" and "downward," were used for reasons of convenience to describe the packer and its associated components. However, such orientations are not needed to practice the invention, and thus, other orientations are possible in other embodiments of the invention. For example, in some embodiments of the invention, the packer may be used in a horizontal or lateral well bore.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A packer usable with a subterranean well, comprising:

an assembly to circumscribe multiple mandrels inserted through the packer, the assembly comprising a slip to engage a casing of the well and a sealing element to seal an annulus of the well; and a member separable from the assembly to configure the assembly for connection to the mandrels, the member including a first seal between the member and the mandrels and a second seal between the member and the assembly, the first seal being separate from the second seal.

2. The packer of claim 1, wherein the assembly comprises:

a shell to circumscribe the mandrels, wherein the sealing element circumscribes the shell.

3. The packer of claim 1, wherein the member comprises a bulkhead.

4. The packer of claim 1, wherein the assembly further comprises:

at least one piston to compress the sealing element to seal the annulus of the well.

5. The packer of claim 1, wherein the packer does not include a sealing element located directly between the assembly and any of the mandrels.

6. The packer of claim 1, further comprising:

another member separable from the assembly, said another member including a third seal between said another member and the mandrels and a fourth seal between the member and the shell, the third seal being separate from the fourth seal.

7. The packer of claim 6, wherein the member and said another member form a region for communicating fluid to control at least one of the slip and the sealing element.

8. The packer of claim 1, wherein the first seal comprises a sealing ring.

9. The packer of claim 8, wherein the second seal comprises a sealing ring.

10. A method comprising:

providing an assembly comprising a slip to engage a casing of the well and a sealing element to seal an annulus of the well;

selecting between a first member separable from the assembly to configure the assembly for connection to a first tubular configuration and a second member separable from the assembly to configure the assembly for connection to a second tubular configuration different from the first tubular configuration; and based on the selection, connecting the selected member to the assembly.

11. The method of claim 10, wherein the first tubular configuration comprises a single mandrel extending through the assembly.

12. The method of claim 10, wherein the second tubular configuration comprises multiple mandrels extending through the assembly.

13. The method of claim 10, wherein the first and second members comprise different sealing bulkheads.

14. The method of claim 10, further comprising:

forming a first seal between the selected member and the assembly; and forming a second seal between the selected member and one of the first and second tubular configurations.

15. The method of claim 14, further comprising:

not forming a seal directly between said one of the first and second tubular configurations and the assembly.

16. A method usable with a subterranean well, comprising:

providing a shell to circumscribe multiple mandrels that are inserted through a packer;

mounting a slip to engage a casing of the well and a sealing element to seal an annulus of the well on the shell;

connecting a member separable from the shell to the shell to configure the shell for connection to the mandrels;

forming a first seal between the member and the mandrels; and forming a second seal between the member and the shell, the first seal being separate from the second seal.

17. The method of claim 16, wherein the member comprises a bulkhead.

18. The method of claim 16, comprising:

not forming a seal directly between the shell and the tubular array.

19. A packer usable with a subterranean well, comprising:

a shell to circumscribe multiple mandrels inserted through the packer;

a slip attached to the shell and adapted to engage a casing of the well;

a sealing element circumscribing the shell and adapted to seal an annulus of the well; and a member separable from the shell to configure the shell for connection to the multiple mandrels, the member including a first seal between the member and at least one of the mandrels and a second seal between the member and the shell, the first seal being separate from the second seal.

20. The packer of claim 19, wherein the member comprises a bulkhead.

21. The packer of claim 19, the packer further comprising:

at least one piston attached to the shell and adapted to compress the sealing element to seal the annulus of the well.

22. The packer of claim 19, wherein the packer does not include a sealing element located directly between the shell and said at least one of the mandrels.

23. The packer of claim 19, wherein the first seal comprises a sealing ring.

24. The packer of claim 23, wherein the second seal comprises a sealing ring.

25. A method usable with a subterranean well, comprising:

providing a shell to circumscribe multiple mandrels inserted through a packer;

mounting a slip to engage a casing of the well and a sealing element to seal an annulus of the well on the shell;

connecting a member separable from the shell to the shell to configure the shell for connection to a tubular array;

forming a first seal between the member and at least one of the mandrels; and forming a second seal between the member and the shell, the first seal being separate from the second seal.

26. The method of claim 25, wherein the member comprises a bulkhead.

27. The method of claim 25, further comprising:

not forming a seal directly between the shell and said at least one mandrel.

28. A packer usable with a subterranean well, comprising:

an assembly to circumscribe one out of multiple tubular arrays inserted through the packer, the assembly comprising a slip to engage a casing of the well and a sealing element to seal an annulus of the well;

a member separable from the assembly to configure the assembly for connection to said one out of multiple tubular arrays, the member including a first seal between the member and the tubular array and a second seal between the member and the assembly, the first seal being separate from the second seal; and another member separable from the shell, said another member including a third seal between said another member and the tubular array and a fourth seal between the member and the shell, the third seal being separate from the fourth seal.

29. The packer of claim 28, wherein the assembly comprises:

a shell to circumscribe said one out of multiple tubular arrays, wherein the sealing element circumscribes the shell.

30. The packer of claim 28, wherein the member comprises a bulkhead.

31. The packer of claim 28, wherein the assembly further comprises:

at least one piston to compress the sealing element to seal the annulus of the well.

32. The packer of claim 28, wherein the packer does not include a sealing element located directly between the assembly and said one of the multiple tubular arrays.

33. The packer of claim 32, wherein the member and said another member form a region for communicating fluid to control at least one of the slip and the sealing element.

34. The packer of claim 28, wherein said one out of multiple tubular arrays comprises:

a single mandrel.

35. The packer of claim 28, wherein said one out of multiple tubular arrays comprises:

multiple mandrels.

36. The packer of claim 28, wherein first seal comprises a sealing ring.

37. The packer of claim 36, wherein the second seal comprises a sealing ring.

38. A method usable with a subterranean well, comprising:

providing a shell to circumscribe one out of multiple tubular arrays inserted through a packer;

mounting a slip to engage a casing of the well and a sealing element to seal an annulus of the well on the shell;

connecting a member separable from the shell to the shell to configure the shell for connection to a tubular array;

forming a first seal between the member and the tubular array;

forming a second seal between the member and the assembly, the first seal being separate from the second seal;

forming a third seal between another member and the tubular array; and forming a fourth seal between said another member and the tubular array.

39. The method of claim 38, wherein the member comprises a bulkhead.

40. The method of claim 38, further comprising:

not forming a seal directly between the shell and the tubular array.

41. The method of claim 38, wherein the tubular array comprises a single mandrel circumscribed by the shell.

42. The method of claim 38, wherein the tubular array comprises multiple mandrels circumscribed by the shell.

* * * * *